United States Patent [19]

Widmayer

[11] 4,371,812

[45] Feb. 1, 1983

[54] LIGHT REGULATION SYSTEM

[75] Inventor: Don F. Widmayer, Bethesda, Md.

[73] Assignee: Controlled Environment Systems, Inc., Rockville, Md.

[21] Appl. No.: 51,136

[22] Filed: Jun. 22, 1979

Related U.S. Application Data

[63] Continuation-in-part of Ser. No. 27,740, Apr. 6, 1979, Pat. No. 4,234,820, and a continuation-in-part of Ser. No. 945,842, Sep. 26, 1978, abandoned.

[51] Int. Cl.[3] ..... H05B 41/392

[52] U.S. Cl. ..... 315/291; 315/158; 315/205; 315/208; 315/307; 315/DIG. 4

[58] Field of Search ..... 315/156, 158, 194, 199, 315/205, 208, 291, 307, 311, DIG. 4, DIG. 7

[56] References Cited

U.S. PATENT DOCUMENTS 3,614,527 10/1971 Wirtz ..... 315/199

4,190,795 2/1980 Schultheis ..... 315/158 X

FOREIGN PATENT DOCUMENTS 2510530 9/1976 Fed. Rep. of Germany ..... 315/307

*Primary Examiner*—Eugene R. LaRoche

*Attorney, Agent, or Firm*—Larson and Taylor

[57] ABSTRACT

A light regulation system is provided wherein the light output of a fluorescent lamp(s) is regulated in accordance with the RMS value of the lamp arc current which is automatically adjusted to maintain a referenced ambient light level or arc current. The ballast and associated lamps of the system receive the full line voltage until the lamps are ignited and thereafter the current thereto is automatically limited by limiting the amplitude of the ballast current during the part of each AC voltage half wave that the lamps are ignited. Control between the minimum light level, wherein a minimum arc current flows during each half cycle, to the maximum light level is accomplished by permitting the minimum arc current which flows during the "lamps on" period of each half wave to increase to maximum arc current over a part or all of the period of each half wave that the lamps are on. The light output is thus controlled over a control range using dissipative means to limit the current to the minimum "on" level and then using on-off phase angle switching techniques to provide control from a minimum "on" to full "on" lamp condition.

9 Claims, 9 Drawing Figures

LIGHT REGULATION SYSTEM

CROSS-REFERENCE TO RELATED APPLICATIONS

This application is a continuation-in-part of copending, commonly assigned continuation-in-part applications Ser. No. 945,842 filed on Sept. 26, 1978, abandoned, and Ser. No. 27,740 filed on Apr. 6, 1979, U.S. Pat. No. 4,234,820, issued Nov. 18, 1980. The subject matter of these applications is hereby incorporated by reference.

FIELD OF THE INVENTION

The present invention relates to energy conserving light regulation systems and, in particular, to light regulation systems of this type for use with ballasted gas discharge lamps, including fluorescent lamps.

BACKGROUND OF THE INVENTION

In copending, commonly assigned continuation-in-part application Ser. No. 945,842, filed on Sept. 26, 1978, and continuation-in-part application Ser. No. 27,740, filed on Apr. 6, 1979, there is disclosed a light regulation system which, among other things, is designed to utilize daylight and provide for a power related adjustable level of light. In the system disclosed in these applications, a control transistor operates in the saturated state thereof (full on) until the lamps are fired on and, once the lamps are fired, operates in the so-called linear region thereof from a minimum ("lamps on") current level until the current increases to the point where the ballast limits the current and the transistor is again saturated on. Examining the operation in more detail, a controlled DC level signal is provided at the base of each control transistor in the continuation-in-part application Ser. No. 27,740. When this signal is present, and during the period of time within each AC voltage half wave that the lamp(s) are not ignited, the control transistor is saturated "on" and only the ballast magnitizing current flows (in addition to lamp heater current when rapid-start lamps are employed). It is noted that in this condition, except for an approximate two volt drop in the transistor control circuit, all of the AC line voltage will appear across the primary of the ballast. Further, when the voltage across the lamp(s) rises within the half cycle, the lamps ignite, which changes the ballast's impedance. Because the control transistor was saturated "on" (with a base current greater than that required for the current flowing in the collector) the collector current begins to rise until a level is reached which corresponds to that required by the minority carriers flowing in the base region of the transistor. As the collector current begins to rise, the transistor begins to operate in the so-called linear region thereof and the voltage across the emitter-collector junction increases to the extent of any "excess" voltage. This excess voltage corresponds to the difference between the AC line source voltage and the voltage level the ballast "complied" to in order to supply the transistor limited level of ballast current. In this regard, it is noted that these systems are so-called voltage compliance systems wherein the voltage complies to a current level (in lieu of the current complying to the AC line voltage source).

As is explained in more detail below, the amplitude controlled current technique provided by the systems of the previous applications is dissipative in nature and, in a specific example, the power consumed by the control unit varies up to almost 20 watts at an approximately 90% power input.

SUMMARY OF THE INVENTION

In accordance with the present invention, an improved light regulating system is provided which substantially reduces the power dissipation problem associated with previous systems. In general, the invention provides for utilizing an amplitude controlled minimum "on" level for arc firing of the lamp(s) and cathode heater as well as lamp arc maintenance purposes, and uses phase angle control techniques to switch the ballast current full "on" during a time variable portion of each half wave of the ballast current.

In a first embodiment of the invention, this control is provided through the use of an electronic switch, e.g., a triac, connected across a rectifier bridge circuit in circuit relationship with the control transistor. The electronic switch, when triggered, effectively bypasses, i.e., shorts out, the control transistor (and the conducting bridge diodes) and provides for full arc current flow during the "on" period of the switch within the half cycle.

In a second embodiment, this same control is achieved by directly providing an additional on-off time-related signal at the base of the control transistor so that the transistor is fully saturated "on" during a portion of the cycle and thus maximum arc current flows. This time-related signal is in addition to the amplitude controlled minimum "lamps on" signal which was referred to above and which flows throughout the remainder of the half cycle that the lamps are on.

As discussed hereinafter, a number of different techniques can be used in generating the variable duration on-off control signal for the triac or transistor. In one embodiment, an operational amplifier is used in combination with a ramp generator to produce a DC time related switching signal. One input of the operational amplifier is connected to receive a light related input signal, i.e., an input signal whose magnitude is related to the sensed light in the area in which the lamp(s) being controlled is located or the arc current through the lamps. This signal is compared in the operational amplifier with the ramp voltage produced by the ramp generator and applied to the other input of the operational amplifier. In this way a variable duration control pulse (time related DC level signal) is produced during each half cycle whose duration is dependent on the light related signal and hence on the area lighting.

It is noted that the "combination" control system of the invention wherein a minimum amplitude control signal is used for lamp firing and sustaining, and a phase angle switching control is used thereafter to provide variation over a minimum to maximum light output range, results in lower power dissipation and increased lamp efficacy in terms of light output as a function of power input. In addition, as explained in more detail below, the system also permits two or more ballasts to be operated in parallel from one control unit.

Other features and advantages of the invention will be set forth in, or apparent from, a detailed description of the preferred embodiments of the invention found hereinbelow.

BRIEF DESCRIPTION OF THE DRAWINGS

FIG. 3(*b*) is a schematic circuit diagram of a second embodiment of a transistor control unit-ballast arrangement incorporating the present invention;

FIG. 3(*c*) is a diagram of a half cycle current waveform associated with the combination control technique provided in accordance with the invention;

FIG. 4(*b*) illustrates input and output waveforms associated with the circuit of FIG. 4(*a*);

DESCRIPTION OF THE PREFERRED EMBODIMENTS

As mentioned above, the amplitude controlled current techniques employed in the previous applications referred to suffers certain disadvantages particularly with respect to power dissipation. This point will be explored further in connection with FIGS. 1 and 2 before considering specific embodiments of the invention.

Figure 1:
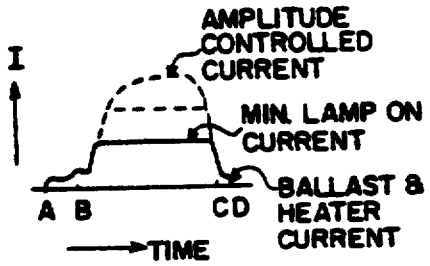
FIG. 1 is a diagram of a half cycle current waveform provided by an amplitude controlled current control system in accordance with my earlier filed applications referred to above.
Figure 2:
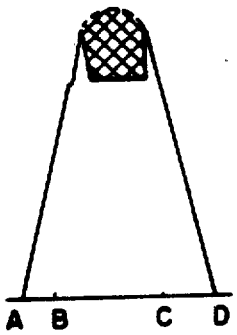
FIG. 2 is a diagram of the corresponding voltage waveform associated with the current waveform of FIG. 1.

Referring to FIG. 1, a current waveform is shown which is an approximation of the waveform of the minimum current flowing in the primary of the ballast during each AC half wave. The dashed lines in FIG. 1 indicate different levels of the amplitude controlled current up to full "on", the latter being shown by the top dashed curve. FIG. 2 shows an approximation of the voltage waveforms over the time frame of FIG. 1 for the minimum "lamp(s) on" condition. The cross-hatched area in FIG. 2 is representative of the voltage appearing across the emitter-collector junction of the control transistor and neglecting the voltage drop of the rectifying bridge, the balance or main portion of the AC voltage wave appears across the ballast. Comparing FIG. 1 and FIG. 2, the current flowing from time A to time B is the ballast current with the lamps off and during this time the ballast "sees" the full instantaneous voltage. At point B, the lamps fire and the current rises to the controlled minimum level. Thereafter, the ballast voltage complies to the level required to provide the transistor limited current, and the excess line voltage appears across the control transistor. Obviously, in this instance, with a voltage across the emitter-collector junction of the control transistor and current flowing through the transistor, the control transistor is operating in the linear region thereof and the power dissipated thereby is the product of the current times the voltage.

Tests have shown that the combination of the forty-watt rapid-start lamps and one standard ballast consumes up to 94 watts (nominally 90 watts in the examples to be considered). Tests have also shown that cathode and lamp firing problems sometimes occur if the minimum controlled current is set at a level lower than that required for 30 watts of input power to the combination of the two forty-watt lamps, the standard ballast and the control unit disclosed in the applications referred to above. In addition, further tests have shown that of the nominal sixty watt reduction (from nominally 90 watts), about 8 watts are dissipated by the control unit at the 30 watt input point. Furthermore, the voltage-ampere characteristics of the combination are non-linear and as the current amplitude is increased, as shown by the dashed lines in FIG. 1, the voltage across the transistor decreases in a highly non-linear fashion, with the watts consumed in the control unit varying up to about 18 watts for the 90 percent power (80 watts) input point. It will be appreciated that this dissipation results in lower lamp efficacy although overall watts are saved in overlit areas and most buildings are overlit most of the time.

On balance, the dissipative nature of the amplitude controlled current provided by the systems of the applications referred to above is clearly undesirable and, as stated above, it is the purpose of this invention to improve upon such systems. As also was discussed previously, the present invention provides for utilizing the amplitude controlled minimum "on" level for arc maintenance purposes, and using phase angle control techniques to switch the ballast current full "on" over some portion of each half wave and this can be accomplished by using an additional time related DC signal on the base of the existing control transistor or introducing a triac across the AC junction nodes of the existing full wave bridge so as to effectively short out the full wave bridge and transistor when the triac conducts.

Figure 3A:
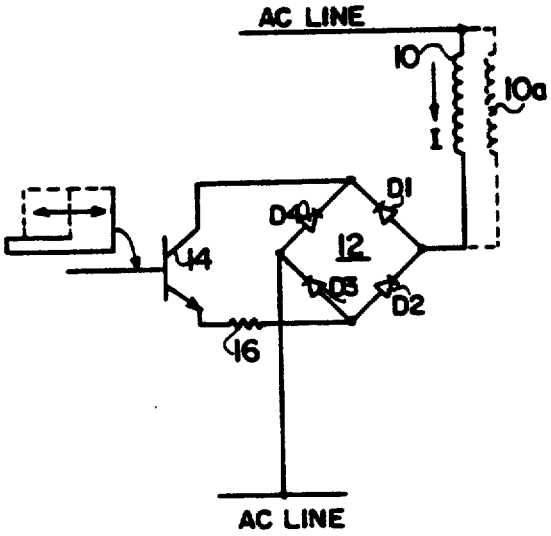
FIG. 3(*a*) is a schematic circuit diagram of a first embodiment of a transistor control unit-ballast arrangement incorporating the present invention.
Figure 3B:
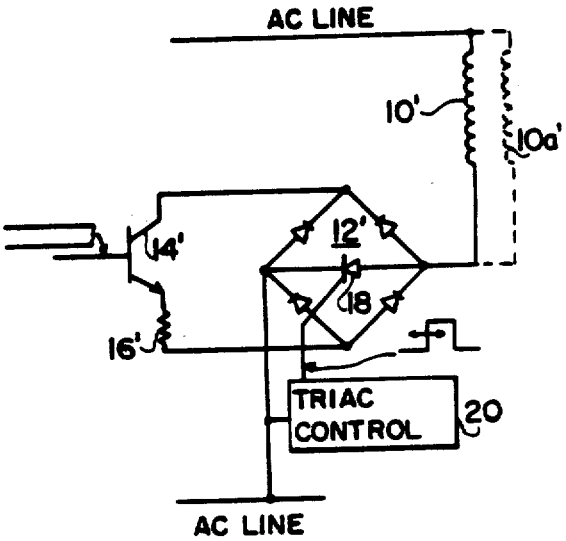
Figure 3C:
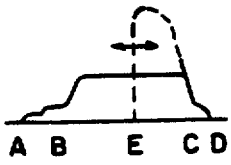

Referring to FIG. 3(*a*), the basic components of a light control system in accordance with a first embodiment of the invention is shown. As shown, a ballast 10 is connected in series with a bridge circuit 12 between the AC lines (e.g. line side and neutral) and a control transistor 14 is connected across the bridge 12 to provide a controlled DC current path around the blocking diodes in the bridge circuit 12. An emitter resistor is indicated at 16 and the bridge is made up of diodes D1, D2, D3 and D4. It will be understood that these basic components are similar to those of the lighting control systems of the earlier filed applications and the principal difference concerns the control signal provided at the base of control transistor 14. As indicated in FIG. 3(*a*), and as described in more detail below, this input switching control signal, also referred to as a DC gate level signal below, includes two components, viz., a minimum amplitude control signal indicated at the leading edge and a phase angle control signal whose duration is variable as indicated by the double headed arrow.

Referring to FIG. 3(*b*), the second embodiment of the invention referred to above is illustrated. This embodiment is similar to that of FIG. 3(*a*) and corresponding components have been given the same numerals with primes attached. The embodiment of FIG. 3(*b*) differs from that of FIG. 3(*a*) in the provision of a triac 18 connected across the junction nodes of bridge 12' as described above, and a control circuit 20 for the triac 18. As indicated in the drawings, in this embodiment, only the minimum DC input signal is provided at the base of transistor 14' and the control signal produced by triac control circuit 20 is similar to the phase angle control signal component of the transistor control signal of FIG. 3(*a*).

FIG. 3(*c*) illustrates the current waveform of the minimum "on" signal coupled with the full "on" signal produced during a variable time period indicated in dashed lines between points E to D, and is valid for the embodiments of both FIG. 3(*a*) and FIG. 3(*b*). Referring to FIG. 3(*c*), it will be seen that the control transistor in both embodiments operates in the linear region thereof between points B and E. Between the points E and C the control transistor (14 or 14') is saturated "on" again by either being switched "on" in the embodiment shown in FIG. 3(*a*) or by virtue of the triac 18 being switched "on" in the embodiment of FIG. 3(*b*). In either instance this results in insufficient voltage across the collector-emitter of the control transistor (14 or 14') for current to flow.

It is noted that the switching control signal for either the control transistor 14 of FIG. 3(*a*) or the triac 18 of FIG. 3(*b*) is essentially the same and hence the cost to generate the signal is more or less the same. The addition of the triac 18 would, of course, result in added cost since the control transistor is in place in the previous systems. However, this cost may be offset by energy savings. To explain, when the ballast current flows in the transistor circuit in the direction indicated in FIG. 3(*a*), the current path includes diode D1, transistor 14, resistor 16 and diode D3. Thus, there are two diode voltage drops plus that of the transistor 14 and emitter resistor 16 for a total of about two volts, at the minimum, for the specific circuit under consideration. Moreover, the circuit, when "full on" at one ampere RMS, would dissipate at least two watts which, over a ten year life at 5,000 hours per year, would result in a consumption of 100 KWH at a cost of several dollars. The triac circuit when full "on" would consume substantially less than 100 KWH over its lifetime and hence, the additional cost of the triac can be justified on both economic and energy saving grounds.

Figure 4A:
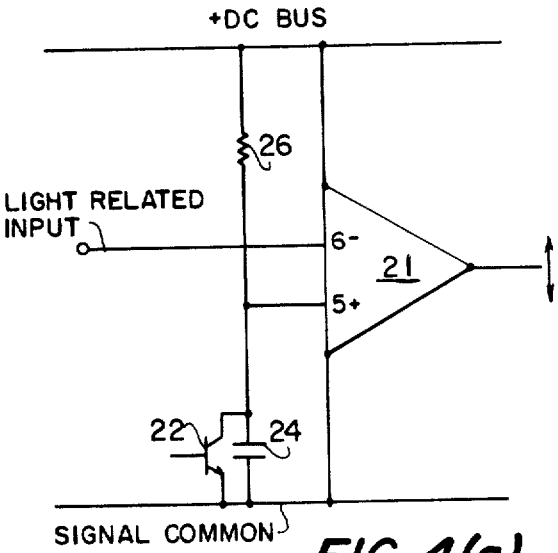
FIG. 4(*a*) is a schematic current diagram of a preferred embodiment of a circuit for generating a time related gate level control signal.
Figure 4B:
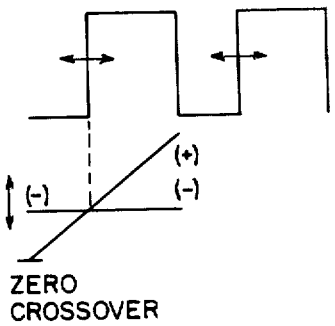

Techniques for generating a DC gate level signal such as discussed above are well known and need not be elaborated on here. However, one example of a circuit which can be used for this purpose is shown in FIG. 4(*a*) wherein a time-related gate level signal is generated using standard capacitor charging techniques. The circuit of FIG. 4(*a*) includes an operational amplifier 21 which, in the systems described in the applications referred to above, would be connected between the positive DC bus and the "signal common" line. A timing transistor 22, a ramp generating capacitor 24 and a resistor 26 are connected to the positive base input of the operational amplifier 21. The capacitor 24 and resistor 26 form a ramp charging circuit and the timing transistor 22 is switched momentarily on and off at the beginning of each half wave to discharge the capacitor 24 and start the charging ramp again. Thus, the positive base of operational amplifier 21 will range positively from close to the signal common voltage during each half wave. As illustrated, a light related signal is applied to the minus or negative input of operational amplifier 21, i.e., a signal related to the existing lighting as sensed by a suitable optical-electrical transducer as disclosed in the prior applications referred to above. So long as the positive base input of operational amplifier 21 is negative with respect to the minus base, the output of the operational amplifier 21 will remain at the signal common nominal voltage. However, when the instantaneous voltage on the charging capacitor 24 exceeds the voltage on the minus base, the output of the operational amplifier 21 switches positive. This is shown in FIG. 4(*b*) which provides a plot of the output of the operational amplifier 21 in the upper portion thereof and a plot of the voltages at the positive and negative inputs of operational amplifier 21 in the lower portion thereof. Thus a time related DC gate level signal is generated as a function of a light related DC voltage signal applied to the minus base of operational amplifier 21. The circuit of FIG. 4(*a*), with appropriate selection of values and matching of polarities (e.g. reversing of the connections to the positive and negative inputs of the existing operational amplifier), would be inserted in the circuit disclosed in co-pending application Ser. No. 27,740 between the operational amplifier circuit and the minimum signal voltage divider preceding the first stage transistor.

Figure 5:
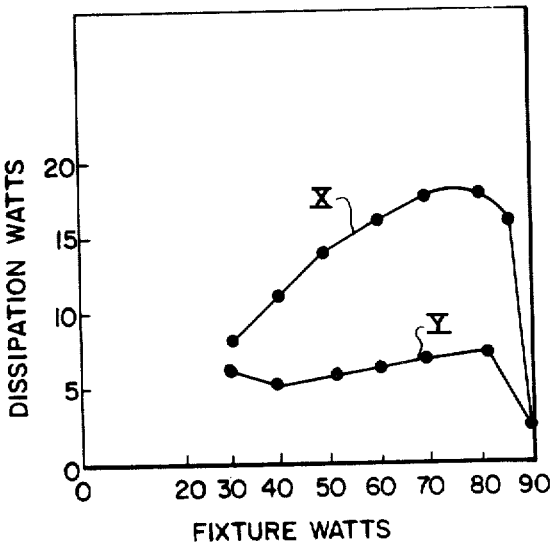
FIG. 5 is a diagram plotting the dissipation power as a function of the power supplied to the fixture for the amplitude controlled current systems of my earlier filed applications and the combination control system of the invention.

Referring to FIG. 5, the measured dissipation in the control unit of the lighting control system of application Ser. No. 27,740, indicated by curve X, is compared with the measured dissipation for the above-described combination amplitude controlled minimum-phase angle switching control system of the present invention, indicated by curve Y. As is evident from FIG. 5, the circuit of the present invention provides a very significant decrease in the dissipation in the control unit and thereby possesses substantial advantages over the previous system.

Figure 6:
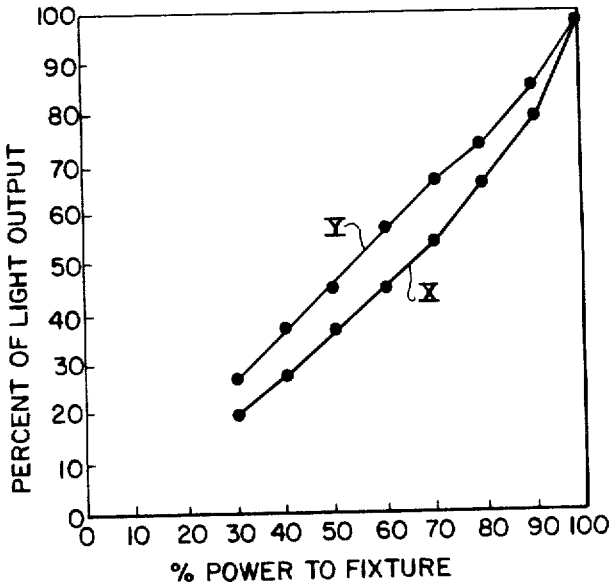
FIG. 6 is a diagram plotting the percent of the light output of the lamps of a typical lamp fixture as a function of the percent power to the lamp fixture for the same systems as in FIG. 5.

Referring to FIG. 6, a plot is provided of the percent of power to a two forty-watt lamp ballast and control unit-equipped fixture as a function of the percent of light output for both the amplitude controlled current light control system of the previous applications (curve X) and the combination amplitude controlled minimum-phase angle switching control system of the invention (curve Y). Again, it will be seen that very substantial advantages accrue from the present invention with respect to actual light output in that improvement with respect to dissipation is directly reflected in increased power to the lamp(s).

A further advantage of the minimum on/phase angle switching control of the invention is that two or more ballasts can be employed with only a single control unit because the current division problem between the two ballasts described in Ser. No. 945,842 does not exist in the switching mode provided in accordance with the present invention. As explained in the application in question, the problem does occur in attempting to divide the current between two ballasts when operating in the amplitude controlled linear region of the transistor. If two ballasts are connected in parallel as shown in FIG. 3(*a*) and 3(*b*), wherein the second ballasts are shown in dashed lines and denoted 10*a* and 10*a*', respectively, the lamps heaters would heat up before lamp firing occurs. The lamp(s) of one ballast would then more than likely be brighter than the lamp(s) of the second ballast because of impedance differences. However, both groups of lamp(s) would be ignited with some level of cathode heating voltage greater than the minimum amount required for adequate thermionic emission for the related low arc level. Thus, the unbalanced light condition is corrected shortly after the phase angle control starts to operate, and hence, except for the initial, barely noticeable light differences, two or more ballasts can be used with a single control unit without the undesired effects associated with previous systems and with a reduction in control unit dissipation.

Although the invention has been described with respect to exemplary embodiments thereof, it will be understood that variations and modifications can be effected in the embodiments without departing from the scope or spirit of the invention.

I claim:

1. A light regulating system comprising:

at least one gas discharge lamp operating in the arc discharge region thereof, a ballast connected from an AC supply line to said at least one lamp, and a transistor control unit for controlling the current flow through said ballast, said transistor control unit including a control transistor and control means for controlling said transistor so as to provide operation of said transistor in the linear region thereof such that the waveform of the current supplied to said ballast during each half cycle comprises a first, low amplitude component corresponding to the minimum arc current for said at least one lamp and for additionally providing that said waveform of said current includes a second, variable duration component corresponding to maximum arc current, the duration of the second current component being a function of the controlled lighting in the area in which said at least one lamp is located.

2. A light regulating system as claimed in claim 1 wherein said control means comprises an electronic switch and a time-related gate level signal producing control unit for triggering said electronic switch in response to a light related input signal so as to bypass said control transistor during the period in said half cycle during which said electronic switch is triggered.

3. A light regulated system as claimed in claim 2 wherein said electronic switch comprises a triac.

4. A light regulating system as claimed in any one of claims 2 or 3, wherein said control means further provides a minimum arc current signal to the base of said control transistor so that said transistor, when not bypassed by said electronic switch, provides the minimum arc current component of said current waveform.

5. A light regulating system as claimed in claim 1 wherein said control means is connected to the base of said control transistor and provides a minimum arc current signal which provides that said transistor operates in the linear mode to provide the said low amplitude arc current component of said current waveform and a variable duration maximum arc current signal which provides that said transistor is saturated fully "on" so as to provide the maximum arc current component of said current waveform.

6. A light regulating system as claimed in any one of claims 2, 3 or 5 wherein said control means comprises a ramp generator and an operational amplifier for receiving the output of said ramp generator at one input thereof and for receiving a light related signal at the other input thereof.

7. A system as claimed in claim 5 wherein said transistor is also saturated full on during an initial period prior to said first period.

8. A light regulating system as claimed in claim 7 wherein said rectifier bridge is connected between said ballast and one side of the supply.

9. A light regulating system as claimed in claim 2 where said electronic switch is connected across a rectifier bridge.

* * * * *